United States Patent [19]

Markel

[11] 4,292,700

[45] Oct. 6, 1981

[54] SLEEPING BAG LINER

[76] Inventor: Raymond A. Markel, 1606 Monte Dr., Mandan, N. Dak. 58554

[21] Appl. No.: 120,507

[22] Filed: Feb. 11, 1980

[51] Int. Cl.[3] ..... A47G 9/08

[52] U.S. Cl. ..... 5/413; 2/69.5; 5/498

[58] Field of Search ..... 5/494–498, 5/416, 413; 2/69.5

[56] References Cited

U.S. PATENT DOCUMENTS

| | | | |
|---|---|---|---|
| 2,695,414 | 11/1954 | Ford et al. | 5/497 |
| 2,972,757 | 2/1961 | Adrain | 2/69.5 |
| 3,178,734 | 4/1965 | Carrez | 5/413 |
| 3,514,796 | 9/1970 | Dibrell | 5/416 |
| 4,063,319 | 12/1977 | Smith et al. | 5/416 |
| 4,128,908 | 12/1978 | Kerbs | 5/413 |

OTHER PUBLICATIONS

Printed Pub., Eddie Bauer, 5th & Union, P.O. Box 3700, Seattle, Wash. 98124

*Primary Examiner*—Ramon S. Britts
*Assistant Examiner*—Alexander Grosz
*Attorney, Agent, or Firm*—Merchant, Gould, Smith, Edell, Welter & Schmidt

[57] ABSTRACT

A sleeping bag liner (10) is disclosed. A hood panel (20) extends across the head portion of the top and bottom panels (26, 28) of liner (10). Buttons (40, 42) are fastened to the foot portions of the bottom panel of a sleeping bag (12) to correspond with buttonholes (36, 38) in the foot portion of liner (10). The attachment of liner (10) to the foot portion of sleeping bag (12) with buttons (40, 42) prevents liner (10) from entangling about a user's feet. Engagement of hood panel (20) about the head portion of sleeping bag (12) prevents liner (10) from undesirably sliding too far into sleeping bag (12) and additionally protects the head portion edges of sleeping bag (12) from becoming soiled.

5 Claims, 5 Drawing Figures

SLEEPING BAG LINER

FIELD OF THE INVENTION

This invention relates to bedding accessories, and, in particular, to a sheet liner for sleeping bags.

BACKGROUND OF THE INVENTION

There are generally two varieties of sleeping bags. One type is a rectangular, zippered bag having top and bottom panels. A second type is a so-called mummy bag having a substantially single-piece casing that can be opened at least along the upper head portion of the bag. Both types of bags are filled with an insulating thermal material such as down. A problem associated with both types of sleeping bags is that when they become soiled, they are very difficult to wash. Furthermore, repeated washing of sleeping bags usually produces an uneven mat of the thermal material, leading to a loss of insulation value of the bag.

Sleeping bag liners have been used in the past to prevent sleeping bags from becoming soiled. The liners were removable and could be washed. One such liner was completely nonattachable to a sleeping bag. Another such liner was attachable by tying strings on the sleeping bag to loops on the liner. Problems which have occurred with these previous liners include the foot portion of the liner becoming entangled with the feet of the user, and the head portion of the liner sliding downward into the bag, leaving the upper edge opening of the sleeping bag, the part which wraps around a user's neck or head, unprotected.

SUMMARY OF THE INVENTION

The present invention is comprised of top and bottom panels joined along the lower edges of the foot portion of the panels and at least partially along both sets of side edges, means attached to the head portions of the top and bottom panels for engaging the head portion of the sleeping bag and retaining the liner from moving undesirably toward the foot portion of the bag, and means for attaching the foot portion of the liner to the foot portion of the bag to prevent the foot portion of the liner from becoming entangled with the feet of a person sleeping in the bag.

In a preferred embodiment, the liner is comprised of an elongate sheet having in its head portion a transverse fold with seams along both sets of side edges to create a hood. A further fold is made longitudinally at the center of the sheet to create top and bottom panels with seams sewn along the corresponding foot portion edges of the panels and partially up the corresponding side edges of the panels. The hood is outside the panels created by the longitudinal fold. A second transverse seam is sewn across the foot portion of the liner a distance spaced-apart upwardly from the foot portion edge seam. Two spaced-apart buttonholes are sewn in the rectangular area between the two parallel, transverse seams. Buttons or equivalent devices, generally corresponding in location to the buttonholes in the liner, are fastened in the interior foot portion of a sleeping bag. To use, the liner is attached to the buttons in the interior foot portion of the sleeping bag and the hood is fitted over the head portion of the sleeping bag.

The invention is unique in its simple method of attachment to a sleeping bag. Any camping type person can easily fasten two buttons or equivalent devices in the interior foot portion of almost any design of sleeping bag, particularly the rectangular and mummy varieties discussed previously. The invention is then easily attached by attaching the liner to the bag. This simple attachment efficiently prevents a person's feet from becoming entangled in the liner.

Another advantage of the liner is that a hood is included which can fit about the head portion of any design of sleeping bag. The hood not only retains the liner from moving downwardly into the bag, but also protects the head portion edges of a sleeping bag from becoming soiled by perspiration from around a person's neck and head or the saliva from a sleeping person's mouth.

It is particularly advantageous that the liner is universal in nature. Even though the liner has a particular shape, it will fit within the interior of almost any sleeping bag by appropriately folding excess liner material, and it will easily attach to the buttons fastened in the interior foot portion of any bag. Furthermore, the hood will fit almost any shape the head portion of a sleeping bag may take.

For a still better understanding of the invention, its advantages and objects obtained by its use, reference should be had to the drawings which form a further part hereof, and to the accompanying descriptive matter, in which there are illustrated and described preferred embodiments of the invention.

DESCRIPTION OF THE PREFERRED EMBODIMENT

Figure 1:
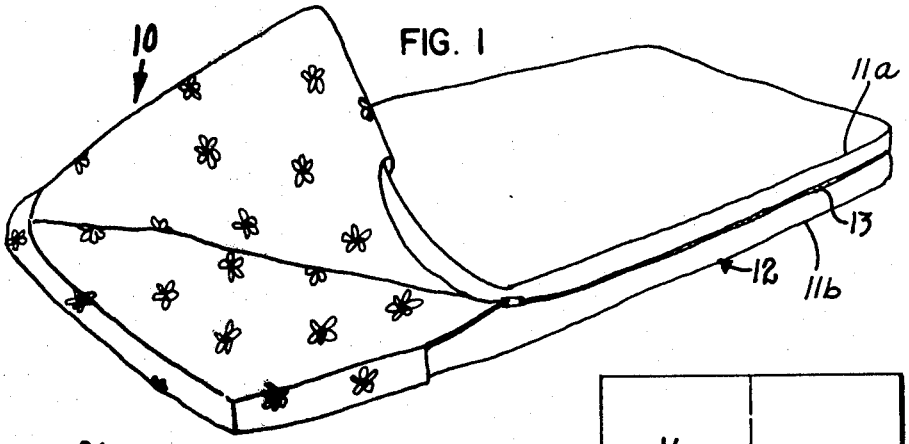
FIG. 1 is a perspective view of the liner as installed in a rectangular sleeping bag.

Referring now to the drawings wherein like reference numerals designate identical or corresponding parts throughout the several views, and more particularly to FIG. 1, the present invention, a sleeping bag liner, is designated generally as 10. Liner 10 shown with a flower pattern is installed in a sleeping bag 12. Although sleeping bag 12 is shown as a rectangular bag; it is to be understood that liner 10 is universal in nature and may be used with almost any shape and design of sleeping bag.

Sleeping bag 12 has a top panel or covering expanse 11*a* and a bottom panel or underlying expanse 11*b*. On a rectangular sleeping bag 12 as in FIG. 1, the top panel 11*a* and the bottom panel 11*b* are substantially coextensive and are joined along the foot portion edges and both sets of side edges. A closure mechanism 13 detachably joins top panel 11*a* to bottom panel 11*b* along at least a portion of one set of side edges adjacent the head portion edges of the bag 12.

Alternatively, a mummy sleeping bag, not shown, may be used in combination with liner 10. Such a bag is comprised of a panel having head portion and foot portion edges and side edges. The panel is folded longitudinally to form an interior and an exterior surface. One half of the foot portion edge is joined with the second half of the foot portion edge. One side of the panel is joined with the other side. Depending on the type of mummy bag, at least a portion of the joined edges are detachably joined, including a portion adjacent the head portion edges.

Figure 3:
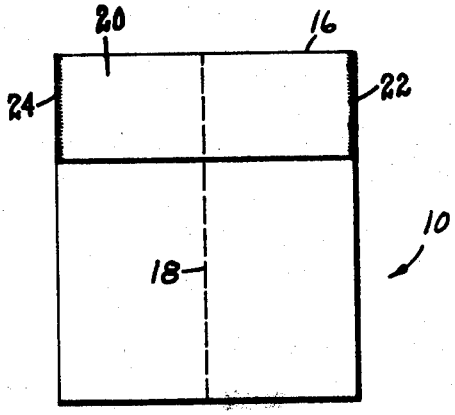
FIG. 3 is a top view showing the sheet after the transverse fold has been made with side stitching shown by hatched lines.
Figure 2:
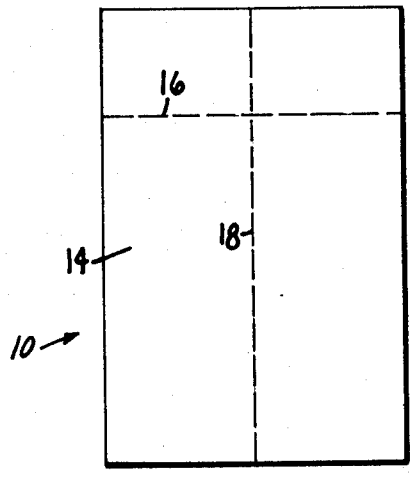
FIG. 2 is a top view of an elongate sheet showing with dotted lines where folds are to be made to produce a liner.
Figure 4:
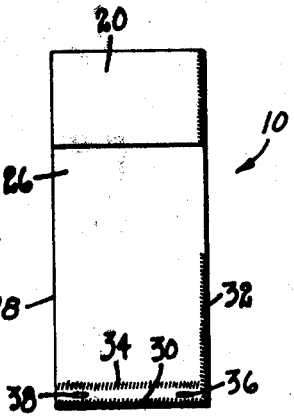
FIG. 4 is a top view of a completed liner.

The solid lines of FIG. 2 illustrate an elongate sheet 14 of material used to make liner 10. Broken lines 16 and 18 illustrate where folds are made during the manufacture of liner 10. A transverse fold 16 is first made in the head portion of sheet 14. Thereafter, a longitudinal fold 18 is made along the longitudinal centerline of sheet 14, as hereinafter described. FIG. 3 illustrates sheet 14 upon completion of transverse fold 16 to create a hood panel 20. Seams 22 and 24, illustrated by hatched lines, are sewn to attach corresponding right and left edges of hood panel 20 and sheet 14. A completed liner 10 is illustrated in FIG. 4. Longitudinal fold 18 is made to create a top panel 26 and a bottom panel 28 (see FIG. 6) such that hood panel 20 is exterior to the contact plane between top panel 26 and bottom panel 28. Seam 30 is sewn to attach corresponding edges at the foot portions of top panel 26 and bottom panel 28. Opposite fold 18, seam 32 is sewn to attach the lower half approximately of corresponding side edges of top panel 26 and bottom panel 28. Seam 34 is parallel to but spaced upwardly from seam 30 by a few inches. Seam 34 attaches top panel 26 to bottom panel 28 and is the lowermost point to which a user's feet may extend. Buttonholes 36 and 38 are centered in the space between seams 30 and 34 and sewn an equivalent few inches on opposite sides of the longitudinal center line of top and bottom panels 26 and 28.

Figure 6:
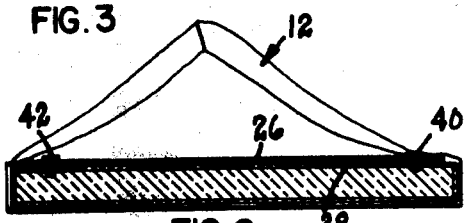
FIG. 6 is a cross-sectional view of the sleeping bag and liner taken along line 6—6 of FIG. 5.
Figure 5:
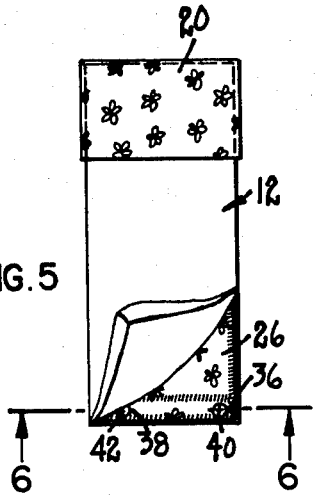
FIG. 5 is a top view of a liner as installed in a rectangular sleeping bag with the foot portion of the top panel of the bag turned up.

Buttons 40 and 42, spaced-apart a distance corresponding to the distance separating buttonholes 36 and 38 in liner 10, are sewn to the foot portion of the bottom panel of sleeping bag 12 as shown in FIGS. 5 and 6.

Alternatively, although not shown in the figures, a button having a pointed, cylindrical shaft extending perpendicularly from the rear surface of the button is punched through the sleeping bag lower panel 11*b*. A disk having a central opening is slid onto the cylindrical shaft until the disk engages a slot in the shaft. Any part of the cylindrical shaft extending beyond the disk is broken or cut off.

In order to use the invention, a sleeping bag 12 is opened to expose its interior. Liner 10 is oriented to have seam 32 on the same side of sleeping bag 12 as closure mechanism 13. The foot portion of liner 10 is matched to the foot portion of bag 12, and buttons 40, 42 are pulled through buttonholes 36, 38 respectively. If sleeping bag 12 is not rectangular, the corners and any other excess material of liner 10 are neatly folded to fit along the interior sides of bag 12. The head portion of sleeping bag 12 is then inserted under hood panel 20 of liner 10. Again, if sleeping bag 12 is not rectangular, any excess material of hood panel 20 is neatly folded for stowage external of sleeping bag 12. A user may now slide between top panel 26 and bottom panel 28 of liner 10 and close sleeping bag 12 at closure mechanism 13. Buttons 40, 42 hold the foot portion of liner 10 to the foot portion of sleeping bag 12 and prevent the entanglement of liner 10 with the user's feet. Enclosed hood panel 20 prevents the head portion of liner 10 from being pulled into sleeping bag 12 by any tossing and turning of the user during his sleep and protects the head portion edge surfaces of sleeping bag 12 from becoming soiled by the user's neck, mouth and hair.

Numerous characteristics and advantages of the invention have been set forth in the foregoing description, together with details of the structure and function of the invention. The disclosure, however, is illustrative only, and it is therefore to be understood that changes may be made in detail, especially in matters of shape, size and arrangement, within the principle of the invention, to the full extent extended by the general meaning of the terms in which the appended claims are expressed.

What is claimed is:

1. A liner for fitting within a sleeping bag having head and foot portions and for preventing the inside of said bag from becoming soiled, said liner comprising:

top and bottom panels having head and foot portions, said panels being joined along foot portion edges and at least partially along both sets of side edges;

means, attached to the head portions of said top and bottom panels, for engaging the head portion of said sleeping bag said engaging and retaining means including a hood panel covering the head portion of said top panel and underlying the head portion of said bottom panel, said hood panel having a first fold where a segment of a head portion edge of said hood panel joins a head portion edge of said top panel and a second fold where a different portion of the head portion edge of said hood panel having one side edge joined to the side edge of said top panel which is not completely joined to said bottom panel and a second side of said edge of said hood panel joined to the side edge of said bottom panel which is not completely joined to said top panel, said hood panel having a third fold approximately midway between said first and second side edges; and retaining said panels from moving undesirably toward the foot portion of said bag;

means for attaching the foot portions of said panels to the foot portion of said bag to prevent the foot portions of said panels from becoming entangled with the feet of a person sleeping in said bag.

2. The combination of a sleeping bag having a top covering expanse and a bottom underlying expanse, said expanses being substantially coextensive and joined along foot portion edges and both sets of side edges, said bag being detachably joined along at least a portion of one set of side edges adjacent head portion edges of said expanses; and a liner for said bag having top and bottom panels with head and foot portions, said panels joined along foot portion edges, partially along one set of opposite side edges and completely along a second set of opposite side edges;

means, attached to the head portions of said top and bottom panels, for engaging said sleeping bag and retaining said panels from moving undesirably toward the foot portion of said bag when a person is sleeping in said bag said engaging and retaining means including a hood panel covering the head portion of said top panel and underlying the head portion of said bottom panel, said hood panel having a first fold where a segment of a head portion edge of said hood panel joins a head portion edge of said top panel and a second fold where fold where a different portion of the head portion of said bottom panel, said hood panel having one side edge joined to the side edge of said top panel which is not completely joined to said bottom panel and a second side edge of said hood panel joined to the side edge of said bottom panel which is not completely joined to said top panel, said hood panel having a third fold approximately midway between said first and second side edges; and means for attaching the foot portion of said panels to the foot portion of said bag to prevent the foot portions of said panels from becoming entangled with the feet of a person sleeping in the bag.

3. A liner in accordance with claims 1 or 2 wherein said attaching means includes a plurality of buttons fastened to the foot portion of the bottom expanse of said sleeping bag and a plurality of buttonholes formed in the foot portion of said joined-together panels, said buttonholes corresponding in location to said buttons when said liner is inserted into said bag, whereby said liner attached to said bag with said buttonholes engaging said buttons is prevented from entangling about the feet of a person sleeping in said bag.

4. The combination of a sleeping bag comprised of a panel having head portion and foot portion edges and side edges, said panel being folded longitudinally to form an interior surface and an exterior surface and having joined together a portion of the foot portion edge with another portion of the foot portion edge and one side edge with the other side edge that at least a portion of said joined-together panel edges adjacent said head portion edges is detachably joined, said panel having at least one button fastened to its interior surface near its foot portion edge, and a liner for said sleeping bag comprised of an elongate sheet with head and foot portions, said sheet folded along a transverse line in its head portion to form a hood panel with two side edges, both said side edges of said hood panel being sewn with seams to corresponding side edge portions of the remainder of said sheet, said sheet further folded along its longitudinal centerline to form first and second sheet panels with foot portion edges, a common folded edge and free side edges, said hood panel being exterior to a common contact surface between said first and second sheet panels, the corresponding free side edges of said first and second sheet panels being at least partially sewn together with a seam and the corresponding foot portion edges of said first and second sheet panels being sewn together with a first transverse seam, said first and second sheet panels being joined further in the foot portions thereof by a second transverse seam spaced-apart and parallel to the first transverse seam, said first and second sheet panels having at least one buttonhole sewn thereto between the first and second transverse seams at a location corresponding to said button in said sleeping bag panel when said liner is installed in said sleeping bag.

5. The method of installing within a sleeping bag a washable liner having a hood at a head portion of said liner and at least one buttonhole adjacent an edge at a foot portion of said liner, said sleeping bag having a head portion and a foot portion, said liner to prevent the interior of said sleeping bag from becoming soiled due to contact with a user, said method comprising the steps of:

fastening at least one button to the foot portion of said bag;

inserting said liner within said bag so that the foot portion of said liner is substantially aligned with the foot portion of said bag and the head portion of said liner is substantially aligned with the head portion of said bag;

attaching said button to said buttonhole; and fitting the head portion of said bag into the hood of said liner.

* * * * *

UNITED STATES PATENT AND TRADEMARK OFFICE

CERTIFICATE OF CORRECTION

PATENT NO. : 4,292,700

DATED : October 6, 1981

INVENTOR(S) : Raymond A. Markel

It is certified that error appears in the above—identified patent and that said Letters Patent is hereby corrected as shown below:

Column 4, line 22, after "bag", insert --retaining said panels from moving undesirably toward the foot portion of said bag,--.

Column 4, line 29, after "panel", insert --joins a head portion edge of said bottom panel, said hood panel--.

Column 4, line 32, after "side", delete "of said".

Column 4, line 37, delete "retaining said panels from moving undesirably toward the foot portion of said bag,".

Column 4, line 65, after "where", delete "fold where".

Column 4, line 66, after "head portion", insert --edge of said head panel joins a head portion edge--.

Signed and Sealed this

*Twenty-fourth* Day of *August 1982*

[SEAL]

*Attest:*

*Attesting Officer*

GERALD J. MOSSINGHOFF

*Commissioner of Patents and Trademarks*